US009988061B2

(12) United States Patent
Graf et al.

(10) Patent No.: US 9,988,061 B2
(45) Date of Patent: Jun. 5, 2018

(54) RAIL VEHICLE WITH A DEFORMATION ZONE

(71) Applicant: Siemens AG Oesterreich, Vienna (AT)

(72) Inventors: Richard Graf, Vienna (AT); Philipp Heinzl, Ezenreith (AT)

(73) Assignee: Siemens AG Österreich, Vienna (AT)

( * ) Notice: Subject to any disclaimer, the term of this patent is extended or adjusted under 35 U.S.C. 154(b) by 242 days.

(21) Appl. No.: 14/892,706

(22) PCT Filed: May 27, 2014

(86) PCT No.: PCT/EP2014/060883

§ 371 (c)(1),
(2) Date: Nov. 20, 2015

(87) PCT Pub. No.: WO2014/195177

PCT Pub. Date: Dec. 11, 2014

(65) Prior Publication Data

US 2016/0096534 A1 Apr. 7, 2016

(30) Foreign Application Priority Data

Jun. 4, 2013 (AT) ..... A 452/2013

(51) Int. Cl.
*B61D 15/06* (2006.01)
*B61D 17/06* (2006.01)
*B61D 1/00* (2006.01)

(52) U.S. Cl.
CPC ..... *B61D 15/06* (2013.01); *B61D 1/00* (2013.01); *B61D 17/06* (2013.01)

(58) Field of Classification Search
CPC ..... B61D 15/00; B61D 15/06; B61D 17/00; B61G 11/00; B61G 11/02; B61G 11/04; B61G 11/06; B61G 11/14; B61G 11/16
See application file for complete search history.

(56) References Cited

U.S. PATENT DOCUMENTS 4,576,294 A * 3/1986 Forster ..... B61G 3/16 213/1 A
6,799,794 B2 * 10/2004 Mochidome ..... B61D 15/06 293/143

(Continued)

FOREIGN PATENT DOCUMENTS

CN 1410306 4/2003
CN 10293155 2/2013

(Continued)

OTHER PUBLICATIONS

Office Action dated Nov. 23, 2016 which issued in the corresponding Chinese Patent Application No. 201480032230.4.

*Primary Examiner* — Robert J McCarry, Jr.
(74) *Attorney, Agent, or Firm* — Cozen O'Connor

(57) ABSTRACT

A rail vehicle including at least one deformation zone arranged at each end side, where the deformation zone has a collision frame, a multiplicity of deformation elements and two A pillars, where the deformation elements are oriented radially about the front structure of the wagon body and are respectively connected at one of their ends to the wagon body, and where the collision frame connects the ends, facing away from the wagon body, of the deformation elements and is arranged about the front structure of the wagon body in an arcuate manner, and where the two A pillars each extend between the wagon body and the collision frame and are permanently connected to the collision frame.

7 Claims, 5 Drawing Sheets

(56) References Cited

U.S. PATENT DOCUMENTS

| | | | | |
|---|---|---|---|---|
| 7,690,314 | B2 | 4/2010 | Clark et al. | |
| 2008/0250965 | A1 | 10/2008 | Clark et al. | |
| 2009/0058109 | A1* | 3/2009 | Mattschull | B60R 19/14 293/102 |
| 2010/0199881 | A1 | 8/2010 | Clark et al. | |

FOREIGN PATENT DOCUMENTS

| | | | |
|---|---|---|---|
| EP | 0802100 | | 10/1997 |
| EP | 1854694 | A2 | 11/2007 |
| GB | 2404635 | A | 2/2005 |
| JP | 2000006806 | A | 1/2000 |
| WO | WO 2005/028275 | A1 | 3/2005 |

* cited by examiner

RAIL VEHICLE WITH A DEFORMATION ZONE

CROSS-REFERENCE TO RELATED APPLICATIONS

This is a U.S. national stage of application no. PCT/EP2014/060883 filed 27 May 2014. Priority is claimed on Austrian Application No. A452/2013 filed 4 Jun. 2013, the content of which is incorporated herein by reference in its entirety.

BACKGROUND OF THE INVENTION

1. Field of the Invention

The invention relates to a rail vehicle with a deformation zone, in particular a passenger rail vehicle 2. Description of the Related Art For the purpose of improving the deformation behavior of rail vehicles during collisions, crash zones are frequently built in. These crash zones or deformation zones, as appropriate, are intended to absorb the impact energy, whereby defined deformable crumple zones convert the impact energy into deformation energy, and thereby minimize the loads on individuals in the vehicle. To this end, it is possible on the one hand to construct extensive regions of the rail vehicle structure such that they can selectively absorb the deformation energy, or special crash modules are attached onto the front or rear structure, as appropriate, of the rail vehicle. This last form of protection is advantageous because any repair after a collision is simplified by the ease of access for these crash modules. Collisions between rail vehicles occur essentially in the direction of the longitudinal axis of the vehicles, although a difference in level due, for example, to different load states of the colliding vehicles, can result in so-called riding up. In the case of rail vehicles (in particular trams) for which there is an increased risk of a collision with obstacles other than another rail vehicle, a particular problem arises. A significantly wider spectrum of collision scenarios must be covered, among which collisions that are offset to one side and oblique are only unsatisfactorily managed by conventional crumple zones or crash modules, which are essentially designed for collisions along the longitudinal direction. Conventional crash modules, designed for longitudinal collisions, often cannot absorb these oblique loadings satisfactorily, because bending and shear loads arise on the crash modules under which the crash element concerned will bend to one side unless there are precautions to provide lateral support. An appropriate design of the familiar crash elements such that they can handle both longitudinal and also oblique collisions equally well would lead to extremely expensive, complicated and heavy crash elements, which are not suitable for use in rail vehicles.

For tram vehicles, standard EN 15277 demands a demonstration of a collision with a vehicle of the same construction at 15 km/h with a 40 mm vertical offset and a collision with a flat obstacle of 3 tons positioned obliquely at 45 degrees at a speed of 25 km/h (collision scenario: train against light goods vehicle at a street intersection).

Hence, other types of collisions, such as with rail vehicles of a different construction, large goods vehicles with high tailgate rails, or collisions while traveling round a curve, are not covered by the demands of the standard.

SUMMARY OF THE INVENTION

In view of the foregoing, it is an object of the invention to provide a rail vehicle with a deformation zone that offers a good level of protection for passengers and the vehicle driver, including in particular in the case of non-axial collisions and collisions with vehicles having a different type of construction.

This and other objects and advantages are achieved in accordance with the invention by a rail vehicle that incorporates at least one deformation zone, each arranged on an end face of the rail vehicle, where the deformation zone incorporates a collision frame, a plurality of deformation elements and two A-pillars, where the deformation elements are aligned radially around the front structure of the wagon body and each is joined to the wagon body at one of its ends, and where the collision frame joins the ends of the deformation elements that face away from the wagon body and is arranged in an arc-shape around the front structure of the wagon body, and where the two A-pillars each extend between the wagon body and the collision frame and are permanently connected to the collision frame.

By this construction, it is possible to achieve the advantage of being able to give a rail vehicle collision properties which, even in the case of oblique collisions, and in particular for collisions with vehicles that are not of the same constructional type (other models of rail vehicle, or goods vehicles), ensure the absorption of the kinetic impact energy in deformation elements. As a result, the deceleration imposed on the passengers and the vehicle personnel can be minimized.

A further important advantage of the present invention lies in the creation of a safe cell around the driver's console. By providing A-pillars (also referred to as ram pillars or corner pillars) and the rigid joining of these A-pillars to the wagon body and to the collision frame, a safe vehicle driver's cab (survival cage) is created. This is advantageous in the case of collisions with high obstacles (goods vehicles), because in particular modern trams have a very low footway level, so that the vehicle driver's position is arranged significantly nearer to the road surface. By the joining of the A-pillars to the collision frame, collision forces that are introduced into the A-pillars are absorbed in the deformation elements, thus relieving the A-pillars of absorbing the energy on their own.

In accordance with the invention, a deformation zone is constructed which incorporates a collision frame. This collision frame has an arc-shaped structure, which is arranged horizontally in front of the wagon body front. Here, the arc can also be made up of individual linear segments. The collision frame is joined to the wagon body via a plurality of deformation elements. These deformation elements are here arranged essentially radially. Provided on each side of the vehicle is an A-pillar, which extends between the wagon body, advantageously on the side in the roof region, and the collision frame, and is joined to the two components mentioned. This deformation zone, comprising the A-pillars, collision frame and deformation elements, forms on the one hand a rigid survival space for the vehicle driver and, on the other hand, an energy-dissipation zone.

It is particularly advantageous to construct the deformation zone as an assembly that can be manufactured separately from the wagon body, and to provide it with facilities for its removable attachment to a wagon body. As a result, it is possible to advantageously perform a rapid repair of the vehicle by exchanging the deformation zone. For the purpose of removable attachment, threaded connectors are particularly advantageous.

In one preferred embodiment of the invention, the deformation elements are arranged in several horizontal planes.

As a result, it becomes possible to advantageously cover a significantly wider range of collision scenarios.

In a further advantageous embodiment of the invention, the collision frame is joined at the ends of its sides to the wagon body structure.

The inventive deformation zone should advantageously be provided on all the ends of cars that are potentially exposed to a collision, in particular to all the ends of cars that are equipped with a driver's console.

Furthermore, an inventive deformation zone also provides protection in a collision when cornering, whereas conventional deformation zones offer no protection, or only limited protection, in this situation.

It is in addition to be recommended that the vehicle nose is equipped with protection against riding up (an anti-climber). This makes it possible to achieve the advantage, in the case of a collision with a vehicle of the same constructional type that is also equipped with an anticlimber, of being able to prevent the very dangerous "riding up", which can lead to the complete destruction of the passenger space.

The anticlimber, generally engineered as a plate-shaped component with a toothed structure, should here be arranged on the collision frame at the first point of contact in a collision (i.e., the vehicle nose).

In a further advantageous embodiment of the invention, a front deformation element (first deformation stage) is arranged on the nose of the car. As a result, it is possible to achieve protection for minor collisions, in particular with vehicles of the same constructional type, such as those collisions that frequently occur in railroad stations or shunting operations. As a result, the rest of the deformation zone will remain undamaged by the activation of the front deformation element so that repair costs are essentially minimized.

It is advantageous to engineer the deformation elements as so-called crash-tubes because a desired deformation behavior, in particular a defined level of force during the deformation, can be prescribed by design. Alternatively, the deformation elements can also be engineered by means of other technologies, e.g. as metal foam elements.

The use of the present invention is advantageous, in particular, on tram vehicles, because these are exposed particularly often to non-axial collision scenarios.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Shown by way of example are.

DETAILED DESCRIPTION OF THE EXEMPLARY EMBODIMENTS

Figure 1:
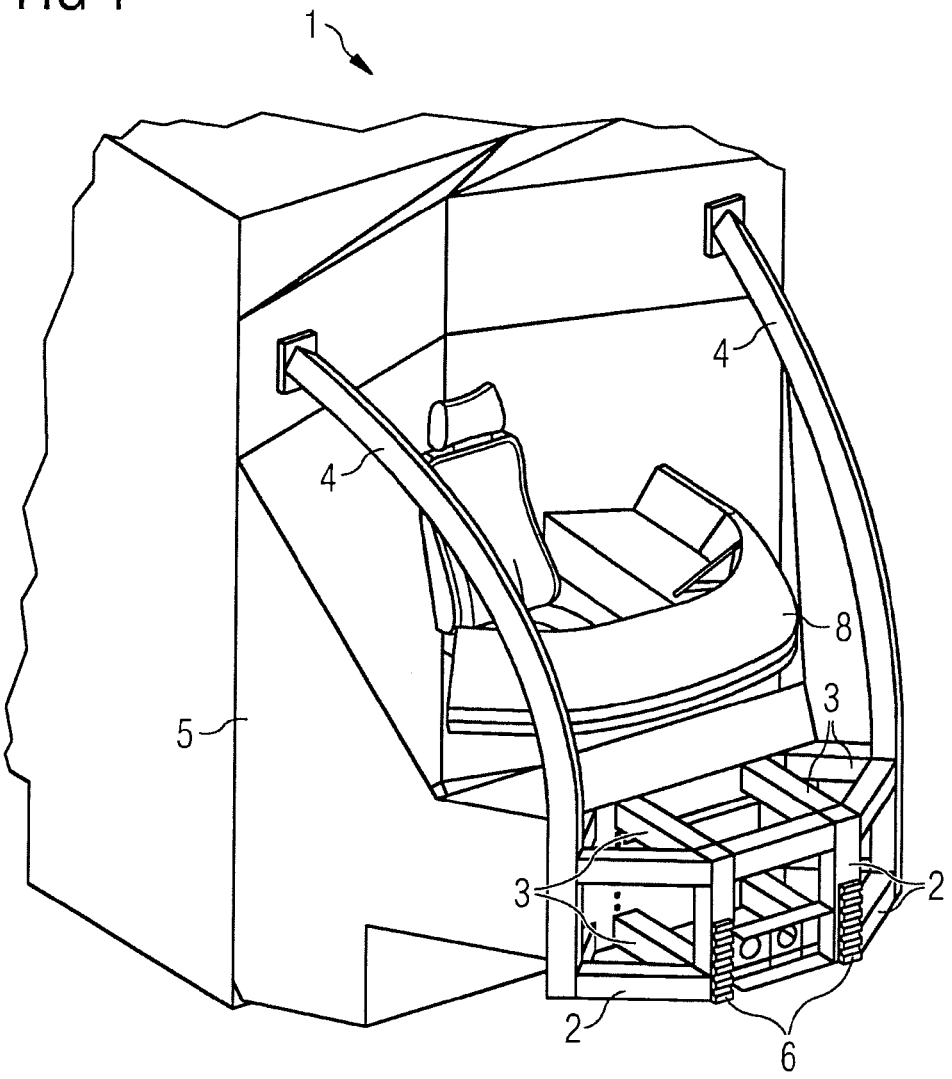
FIG. 1 is an oblique view of a rail vehicle with a deformation zone in accordance with the invention.

FIG. 1 shows by way of example and schematically a rail vehicle with a deformation zone, viewed obliquely. A rail vehicle 1 is shown which is designed as a tram. It incorporates a wagon body 5 with a driver's console 8. On the end face, a deformation zone is provided, incorporating two A-pillars 4, a collision frame 2 and a plurality of deformation elements 3. The collision frame 2 is constructed of several linear segments and extends in an arc shape manner in front of the front end of the wagon body 5. Between the wagon body 5 and the collision frame 2 is a plurality of deformation elements 3, arranged essentially radially or in a fan shape. An exemplary embodiment is shown in which the deformation elements 3 are arranged in two horizontal planes. As a result, the collision frame 2 is implemented as a segment-shaped mesh construction, which joins together the ends of the deformation elements 3 which face away from the wagon body 5. The A-pillars 4 are constructed as curved corner pillars and extend between the wagon body 5 and the collision frame, and each of them is joined to these components. The points where the A-pillars 4 join onto the collision frame 2 should be constructed so rigidly that the forces introduced into the A-pillars 4 can be directed into the deformation elements 3 without these joints failing. The illustrated exemplary embodiment shows a deformation zone with four deformation elements 3 oriented in the longitudinal direction of the vehicle, and on each side two deformation elements 3 aligned roughly at 45 degrees to the longitudinal direction of the vehicle. On the nose of the vehicle, the collision frame 2 is fitted with two anticlimbers 6. Between the two anticlimbers 6, a possible fixing point is provided for a front deformation element 7. Further components, in particular the cladding customary on the noses of vehicles, are not shown in FIG. 1. Because of their low strength, these claddings play no significant part in a deformation event.

Figure 2:
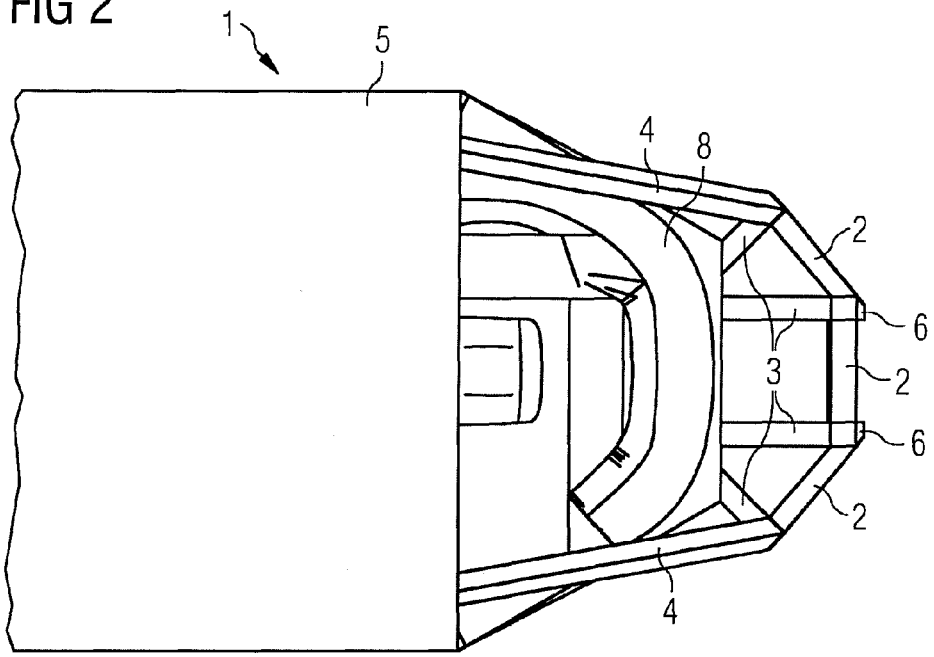
FIG. 2 is a plan view of a rail vehicle with a deformation zone in accordance with the invention.

FIG. 2 shows by way of example and schematically a plan view of a rail vehicle with a deformation zone. Here, FIG. 2 shows the exemplary embodiment from FIG. 1. The radial arrangement of the deformation elements 3 is clearly to be seen.

Figure 3:
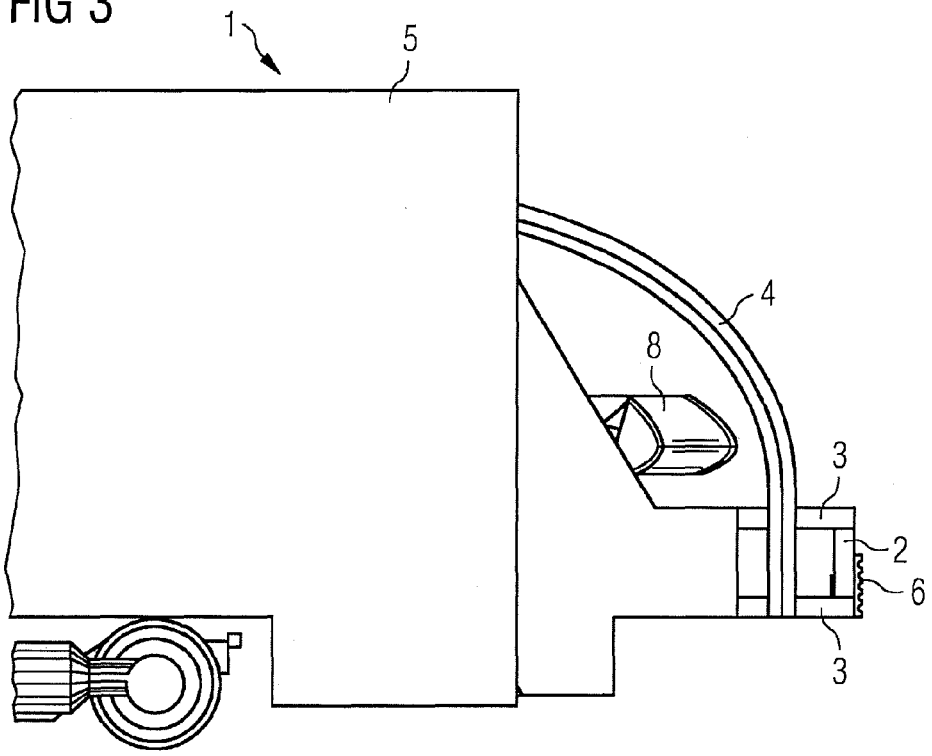
FIG. 3 is a side view of a rail vehicle with a deformation zone in accordance with the invention.

FIG. 3 shows by way of example and schematically a side view of a rail vehicle with a deformation zone. Here, the exemplary embodiment of FIG. 1 is shown.

Figure 4:
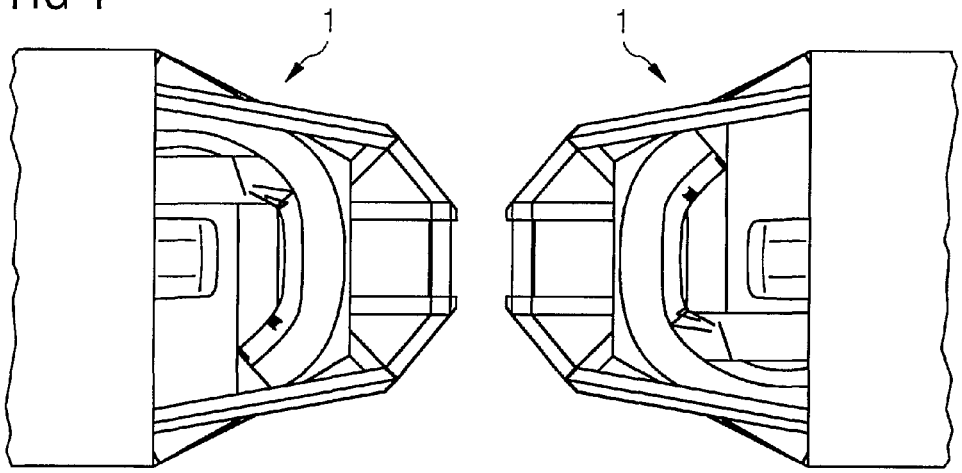
FIG. 4 is a view of vehicles of the same construction, before a collision in accordance with the invention.

FIG. 4 shows by way of example and schematically a collision between two vehicles of the same construction, immediately before the collision. Two rail vehicles 1 like those illustrated in FIGS. 1 to 3 are shown in a position immediately before a collision. The two vehicles 1 are on the same tracks. The illustration shows a collision typical of that in the region of stops.

Figure 5:
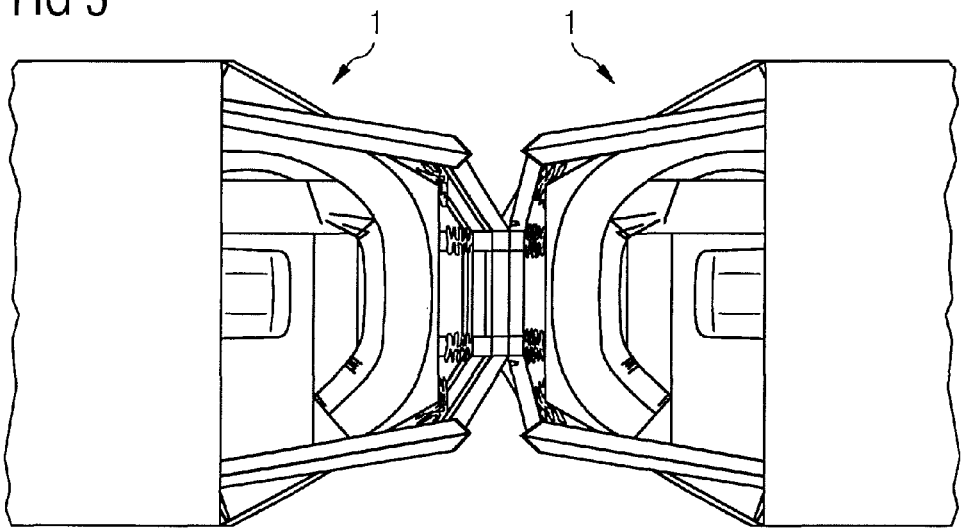
FIG. 5 is a view of vehicles of the same construction, during a collision in accordance with the invention.

FIG. 5 shows by way of example and schematically a collision between two vehicles of the same construction, during a collision. Here, FIG. 5 illustrates the collision scenario of FIG. 4 as it has progressed. The anticlimbers on the two vehicles 1 are hooked into each other and prevent riding up. The deformation elements 3 on the two vehicles 1 have been activated, whereby those on the right-hand vehicle have dissipated more energy. The space around the driver's console 8 has retained a stable shape.

Figure 6:
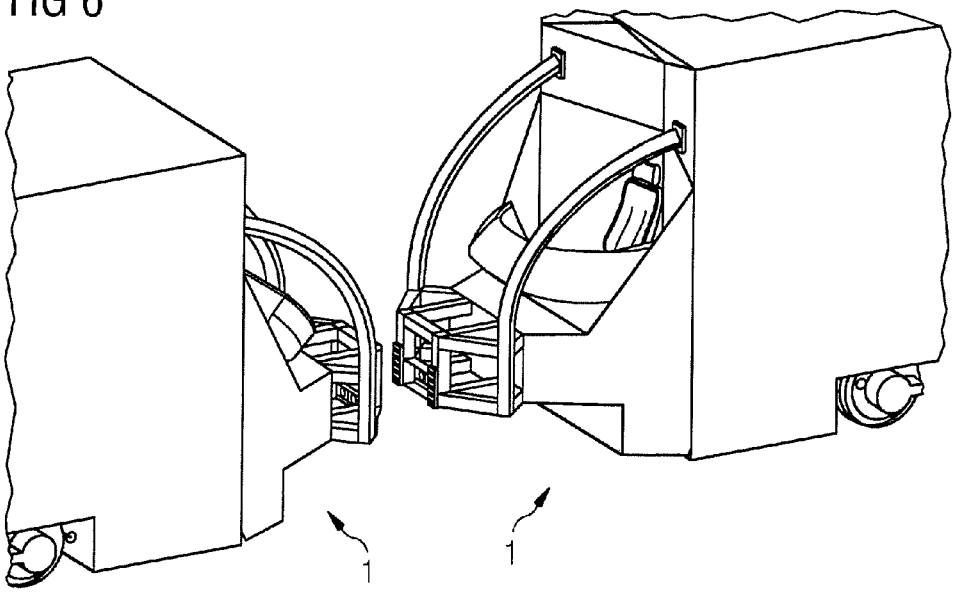
FIG. 6 is a side view of vehicles of the same construction, before the collision in accordance with the invention.

FIG. 6 shows by way of example and schematically an oblique view of a collision between two vehicles of the same construction, immediately before the collision. The situation shown is that from the illustration in FIG. 4.

Figure 7:
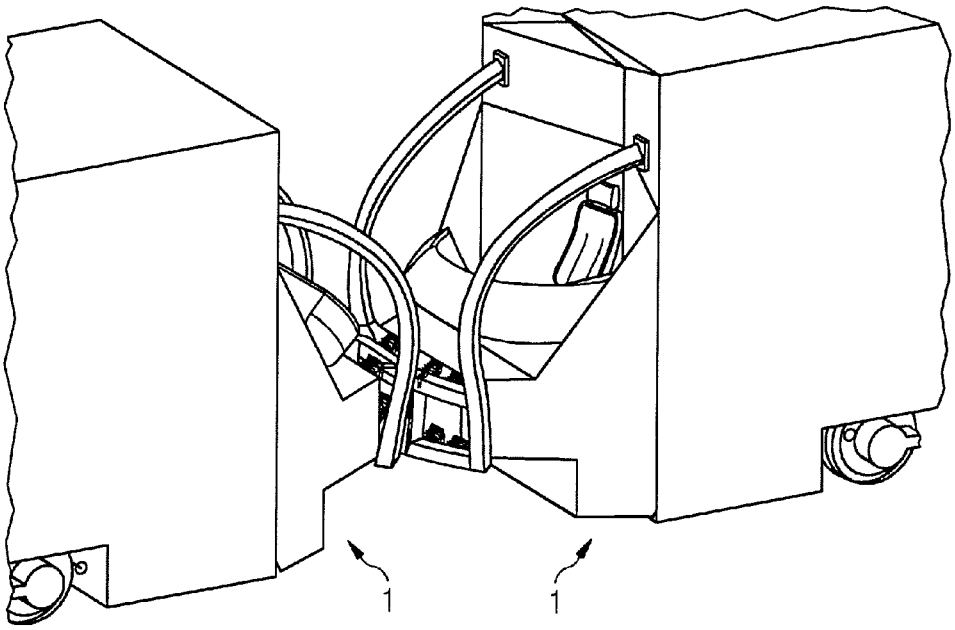
FIG. 7 is a side view of vehicles of the same construction, during the collision in accordance with the invention.

FIG. 7 shows by way of example and schematically a collision between two vehicles of the same construction, as the collision has progressed. The situation shown is that from the illustration in FIG. 5.

Figure 8:
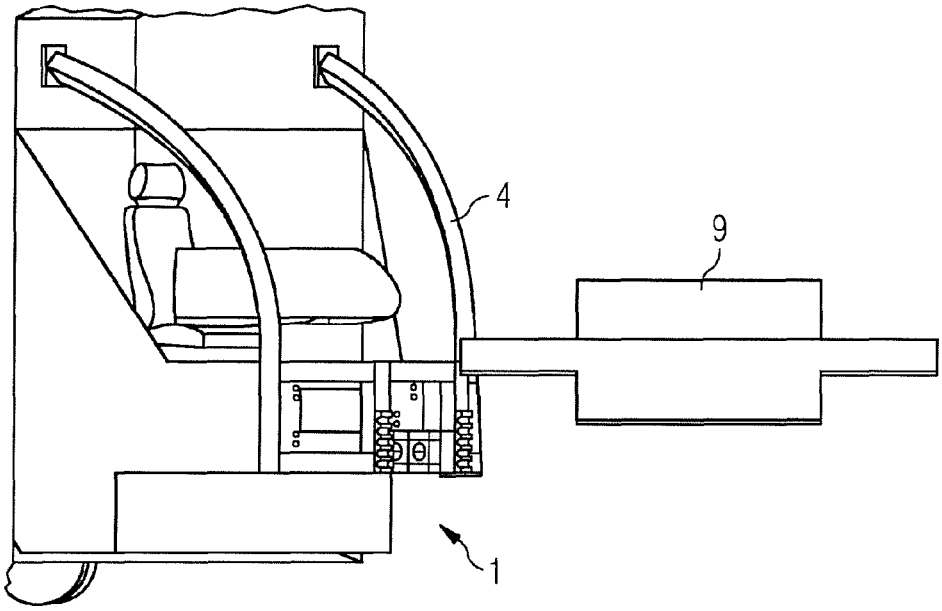
FIG. 8 is a side view of an oblique collision with a goods vehicle in accordance with the invention.

FIG. 8 shows by way of example and schematically a side view of an oblique collision of a rail vehicle with a goods vehicle. The collision scenario illustrated is between a rail vehicle 1 and a goods vehicle 9. The rail vehicle 1 is constructed as shown in FIGS. 1 to 3. Of the goods vehicle 9, only a frame of a load surface is shown, because on the one hand this is the most rigid component of a goods vehicle, and a collision with this frame is one of the most frequent collision scenarios. The collision occurs at an angle of about 45 degrees to the longitudinal axis of the rail vehicle. The A-pillar 4 absorbs the collision energy and converts this energy partially within itself into deformation work and, on the other hand, directs the collision energy into the deformation elements 3. Without the A-pillars, the collision illustrated would be very dangerous for the vehicle driver, because the load surface of the goods vehicle 9 could penetrate unhindered into the vehicle driver's space.

Figure 9:
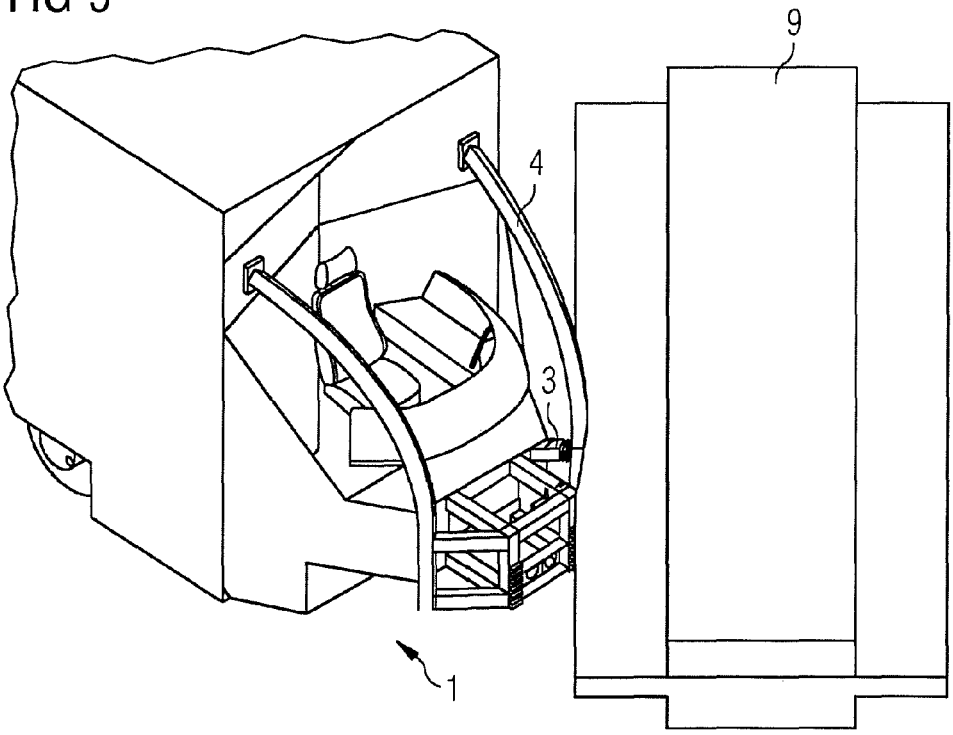
FIG. 9 is an oblique view of an oblique collision with the goods vehicle in accordance with invention.

FIG. 9 shows by way of example and schematically an oblique view of an oblique collision of a rail vehicle with a goods vehicle. An oblique view of the collision scenario from FIG. 8 is illustrated. FIG. 9 shows the activation of the left-hand deformation elements 3 together with a gentle actuation of the deformation elements 3 oriented in the longitudinal direction of the vehicle. A rail vehicle without a deformation zone in accordance with the invention could, even if it were equipped with conventional deformation elements, be practically completely unable to absorb impact energy in such a collision, because the conventional deformation elements would kink outwards and lose their energy dissipating property.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A rail vehicle, comprising:

at least one deformation zone arranged on an end face of the rail vehicle, the at least one deformation zone comprising:

a collision frame having side ends which are joined to the wagon body structure;

a plurality of deformation elements incorporated; and two A-pillars;

wherein the plurality of deformation elements are aligned radially around a front structure of a wagon body of the rail vehicle and are each joined to the wagon body at one end of the wagon body;

wherein the collision frame joins together those ends of the deformation elements which face away from the wagon body and is arranged in an arcuate shaped manner around the front structure of the wagon body; and wherein each of the two A-pillars extends between the wagon body and the collision frame and is permanently connected to the collision frame.

2. The rail vehicle as claimed in claim 1, wherein the plurality of deformation elements are arranged in several horizontal planes.

3. The rail vehicle as claimed in claim 2, wherein the plurality of deformation elements (3) are constructed as crash tubes.

4. The rail vehicle as claimed in claim 1, wherein the plurality of deformation elements are constructed as crash tubes.

5. The rail vehicle as claimed in claim 1, wherein the at least one deformation zone includes an anticlimber which is arranged on a nose of the vehicle on the collision frame.

6. The rail vehicle as claimed in claim 1, wherein the at least one deformation zone includes a front deformation element which is arranged on the nose of the vehicle on the collision frame.

7. The rail vehicle as claimed in claim 1, wherein the at least one deformation zone is formed as an assembly which is removably affixed to the wagon body.

* * * * *